US005256931A

United States Patent [19]

Bernadet

[11] Patent Number: 5,256,931

[45] Date of Patent: Oct. 26, 1993

[54] ELECTRON SOURCE HAVING A MATERIAL-RETAINING DEVICE

[75] Inventor: Henri Bernadet, Paris, France

[73] Assignee: U.S. Philips Corp., New York, N.Y.

[21] Appl. No.: 775,654

[22] Filed: Oct. 10, 1991

[30] Foreign Application Priority Data

Oct. 12, 1990 [FR] France ..... 90 12613

[51] Int. Cl.[5] ..... H05H 1/03

[52] U.S. Cl. ..... 313/360.1; 313/231.31; 313/231.41; 313/363.1; 315/111.21; 315/111.31; 315/111.81

[58] Field of Search ..... 313/360.1, 362.1, 231.31, 313/231.41; 315/111.21, 111.31, 111.81

[56] References Cited

U.S. PATENT DOCUMENTS

| | | | |
|---|---|---|---|
| 4,507,588 | 3/1985 | Asmussen et al. | 313/231.31 |
| 4,924,138 | 5/1990 | Bernardet | 313/361.1 |
| 4,939,425 | 7/1990 | Bernardet | 315/111.21 |
| 5,107,170 | 4/1992 | Ishikawa et al. | 313/231.31 |

FOREIGN PATENT DOCUMENTS

| | | | |
|---|---|---|---|
| 0286191 | 10/1988 | European Pat. Off. | 313/231.31 |

OTHER PUBLICATIONS

"Grid Controlled Plasma Cathodes" Humphries et al J. Appl. Phys. 57(3) Feb. 1, 1985, pp. 709-713.

*Primary Examiner*—Donald J. Yusko
*Assistant Examiner*—N. D. Patel
*Attorney, Agent, or Firm*—William L. Botjer

[57] ABSTRACT

The present invention relates to a vacuum arc electron source having an anode and a cathode facing each other such that they produce a plasma (P) after an appropriate voltage difference has been applied between the anode and the cathode, an electron extractor device (30) and a material-retaining device arranged between the extractor device and the plasma source. According to the invention, the material-retaining device comprises, arranged in the electron extraction direction (F), at least one upstream baffle (10) and a downstream baffle (20) which are each electrically conducting and have apertures (16, 26) arranged in quincunx, such that when the baffles (10, 20) are adjusted a given potential, the plasma (P) does not extend to downstream of the downstream baffle (20).

8 Claims, 5 Drawing Sheets

ELECTRON SOURCE HAVING A MATERIAL-RETAINING DEVICE

BACKGROUND OF THE INVENTION

The present invention relates to a vacuum arc electron source comprising a plasma source having an anode and a cathode facing each other such that they produce a plasma after an appropriate voltage difference has been applied between the anode and the cathode, an electron extractor device and a material-retaining device arranged between the extractor device and the plasma source.

Such an electron source is disclosed in the article "Grid-controlled plasma cathodes", by S. HUMPHRIES et al., in the "Journal of Applied Physics", vol. no. 3 (February 1985), pages 700–713.

According to this article, the material-retaining device is constituted by an ion control grid (ICG) provided in the plasma and being at the same electric potential as the plasma source, and the extractor device comprising an extraction cathode K constituted by a grid which is biased positive with respect to the plasma source as well as an electron collecting anode A. The ion control grid ICG has for its function to separate the ions of the electrons in the grid ICG—cathode K space, the electrons being extracted or not extracted as a function of the space charge in the extraction gap between the cathode K and the anode A.

Such a structure requires a pulsed operation of the plasma source and a more specific operating condition is, that the pulse length of the plasma must not be too great relative to the pulse length required by the electrons to avoid electric loading of the grid and electric breakdown.

SUMMARY OF THE INVENTION

The basic idea of the invention is, to optically and electrically separate the plasma from the extraction zone so as to avoid the aforesaid drawbacks.

To achieve this object, the electron source according to the invention, is characterized, in that, the material-retaining device includes, arranged in the electron extraction direction, at least an upstream baffle and a downstream baffle which are both electrically conducting and have apertures arranged in quincunx, such that when the baffles are brought to a given potential, the plasma does not extend to downstream of the downstream baffle. This provides an effective preservation of materials, namely ions, neutralized or not, as well as simultaneously emitted neutrals and micro-particles.

At least one aperture may be a slot extending transversely of the electron extraction direction.

At least one baffle may have, arranged around at least one aperture, a folded edge at the plasma source side, thus permitting an improved retention of the ions of the plasma as well as of the neutrals and micro-particles simultaneously emitted by the vacuum arc. In accordance with a preferred embodiment of the material retaining device, the upstream and downstream baffles include the said folded edges, aligned in the electron extraction direction.

The width of the aperture may exceed or be equal to the gap between the apertures. The spacing between the baffles may be at least equal to the aperture width and to the gap between the apertures. The quantity of extracted electrons actually increases versus the relative width of the apertures with respect to their gaps, as well as versus the baffle interspace.

In accordance with a particularly advantageous embodiment as regards the electron beam homogeneity there are provided, in the electron extraction direction, substantially parallel to each other, an upstream extraction electrode and a downstream extraction electrode, the spacing between these electrodes preferably being equal to a distance at least equal to the pitch of said baffle.

At least one extraction electrode can advantageously be arranged in the path located downstream of the apertures of the downstream baffle in the electron extraction direction. Thus, the extraction efficiency at equal potential is improved.

The prior art extraction structures result in electron emission at an energy (expressed in eV) near the extraction voltage but remaining below this voltage. In order to reduce this initial energy and to obtain an improved beam control, it is advantageous to provide an electron energy reducing electrode downstream of the extraction device in the electron extraction direction, it then being possible to obtain such a reduction by adjusting the said electrode to an electric potential less than that of the extractor device.

BRIEF DESCRIPTION OF THE DRAWINGS

The invention will be better understood from the following description, which is given by way of non-limitative example with reference to the accompanying drawings, in which.

DETAILED DESCRIPTION OF THE PREFERRED EMBODIMENTS

Figure 1:
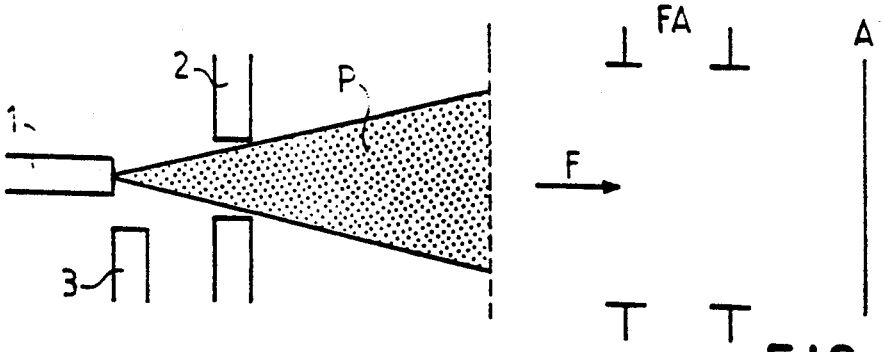
FIG. 1 (PRIOR ART)
FIG. 1 shows an electron source of the prior art (general state of the art), FIG. 2 corresponding to the said article by HUMPHRIES et al

As shown in FIG. 1, an electron source includes an ion source having at least one cathode 1 and one anode 2 (of the diode type) and, optionally, a gate electrode 3 (of the triode type) or a secondary arc as in the French patent application FR 2616587 (tetrode type) which corresponds to U.S. Pat. No. 4,939,425. For the diode type, the anode 2 and the cathode 1 are very close to each other and triggering the plasma arc P is simply obtained by applying an adequate anode voltage. For the triode type, the gate electrode 3 whose position, shape and supply mode allow the excitation of a cathode spot at the base of the main arc P, is close to the cathode 1 whilst the anode 2 is remote therefrom. For the tetrode type, the main plasma arc P is triggered by injecting a plasma obtained from a secondary arc of a short duration relative to the main arc P and dissipating a very low energy with respect to the main arc P.

Similarly, these plasma sources can be realized in the form of thin layers deposited on insulating materials, generally allowing considerable and more reproducible instantaneous emissions, but with a reduced number of operating shots.

The electrons are extracted from the plasma P by an electron extractor device EE (for example a grid), the extraction direction (arrow F) being perpendicular to the extractor device EE. In so far as it is needed, a focusing and accelerating device FA directs the electrons towards a target A.

Figure 2:
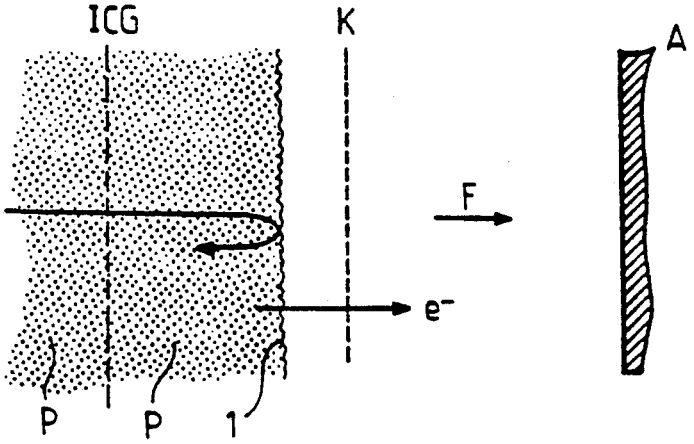
FIG. 2 (PRIOR ART)

FIG. 2 illustrates the device described in the publication by S. HUMPHRIES et al., in accordance with which an ion control grid (ICG) is provided in the plasma P at the same potential as that of this plasma. An extraction cathode K acting as the extraction grid being biased positive relative to the grid (ICG), the voltage difference thus produced prevents the ions from penetrating into the extraction space, i.e. the space located between the cathode K and a target electrode A. In the absence of an extraction potential, the electrons are prevented from crossing the extraction space A-K. It is a condition for the extracted current density that the width of the space in which the separation between the ions and the electrons occurs is substantially equal to or greater than half the width of the apertures of the extraction grid K. A further condition is, that the length of the pulses producing the plasma cannot exceed the pulse length designed for the electrons, to prevent electric loading of the extraction cathode K and to reduce the risk of breakdown. In other words, a plasma pulse must only correspond to one single electron extraction.

Figure 3A:
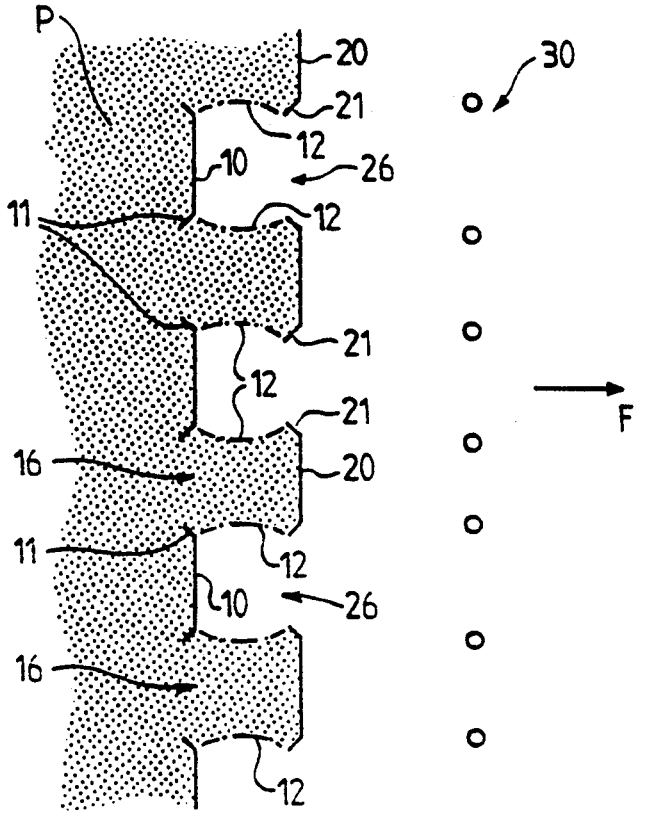
FIGS. 3*a*, 3*b* and 3*c* show an electron source according to an embodiment of the invention, FIG. 3*b* being a detail of FIG. 3*a* showing the field lines, and FIG. 3*c* being a detail of FIG. 3*a* with the object of defining the dimensions.

As is shown in FIGS. 3*a* to 3*c* and 5, the cathode (or anode) plasma is optically isolated by two baffles 10 and 20, comprising, arranged in the electron extraction direction (arrow F) an upstream baffle 10 and a downstream baffle 20, adjusted to ground or anode potential (for a cathode plasma), and provided with apertures 16 and 26, respectively, arranged in quincunx relative to each other. The plasma, in the absence of any extraction voltage, is intercepted by the baffles and cannot penetrate to downstream of the downstream baffle 20. In FIG. 2 (prior art), the grid ICG is provided inside the plasma P, which always extends downstream thereof until it arrives in the proximity of the extraction cathode K. In contrast thereto, in accordance with the invention, the plasma P is stopped by the baffles and cannot extend to downstream thereof. The extraction electrode 30 is, whatever the operating conditions, free from any pollution by the plasma P which can therefore be continuously maintained for the overall duration necessary to obtain the desired number of electron extractions. Furthermore, such a baffle structure at at least two levels also allows the interception of micro-projections emitted by the cathode 1. FIG. 4 shows, at a, the profile of the current Iarc of the plasma source, at b the extraction potential (several pulses, for a single ignition of the plasma), and at c the current Iext of the extracted electrons. For an extraction voltage Vext (of some kV) having a flat plateau profile, the current Iext shows, in a conventional manner, plateaus with negative slopes.

Figure 3B:
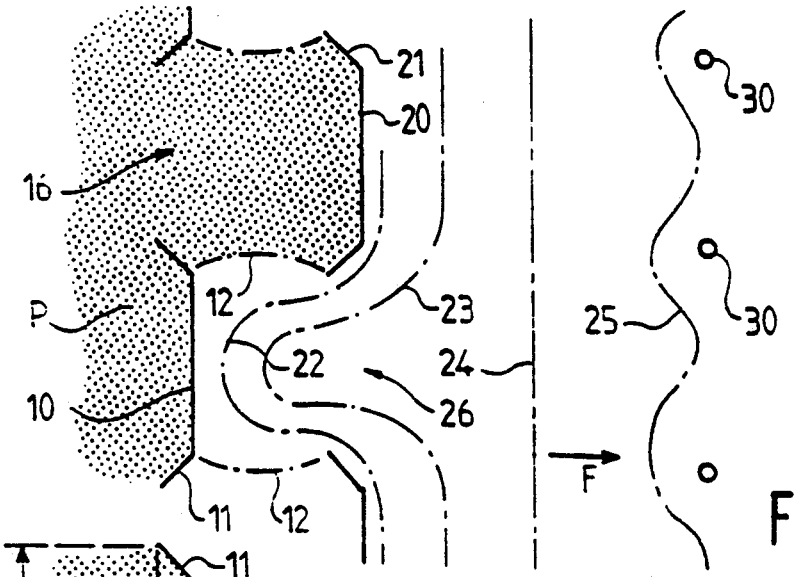
Figure 4A:
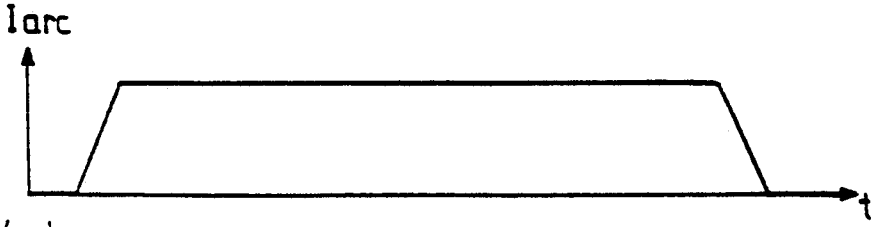
FIGS. 4*a*, 4*b* and 4*c* show current and voltage diagrams with a view to the extraction of electrons.
Figure 4B:
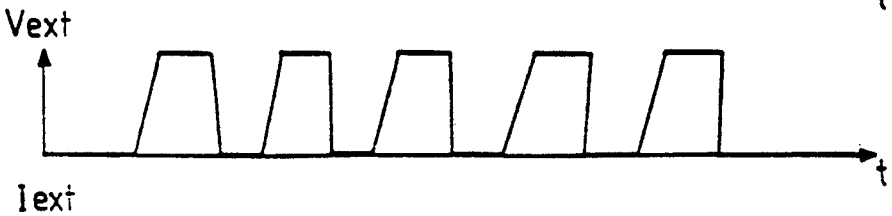
Figure 4C:
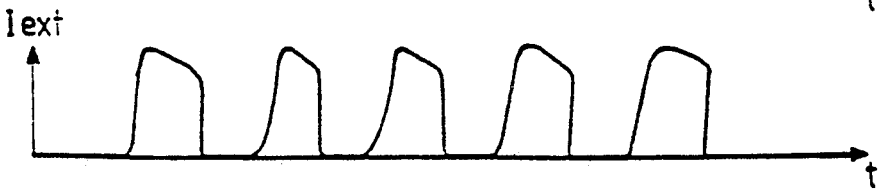
Figure 5:
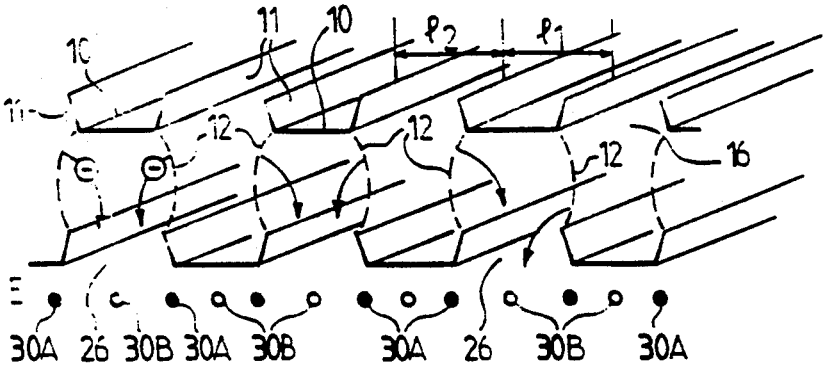
FIGS. 5, 6*a*, 6*b* and 6*c* show embodiments of the apertures in the baffles in accordance with the invention, the FIGS. 6*b* and 6*c* representing in a plan view and in a sectional view XX', respectively, a device having a rotational cylindrical symmetry.

FIG. 3*b* shows the lines of equipotentials between the separating surfaces 12 defining the contours of the plasma and along which the electrons are extracted. These surfaces 12 are a function of the extraction voltage and the density, in electric charges, of the emitted plasma. The surfaces 12 are located between the two baffles 10 and 20, along a general direction perpendicular thereto and substantially from one edge to the other of the apertures 16 and 26. The equipotentials (22 to 25) develop between a shape (22) having a first portion perpendicular to the baffle 20 and a second portion which clearly reenters into the interbaffle space beyond the plasma P, a shape (23) further downstream of the baffles and also having two portions, the second reentering to a less extent into the interbaffle space, a shape (24) located still further downstream and being substantially flat, which permits directing the electrons basically in accordance with the extraction direction F (they are actually basically extracted perpendicularly to this direction) and finally a substantially sinusoidal shape (25) in the vicinity of the extraction grid 30.

Figure 3C:
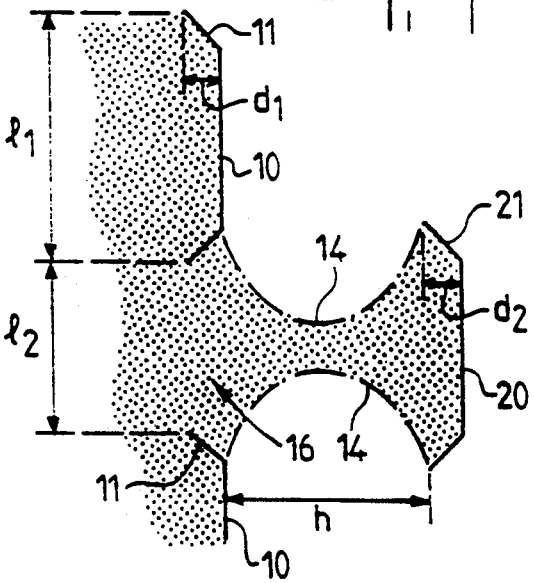

FIG. 3*c* shows a substantially ideal shape (14) of the separation surface 12, with a very pronounced indentation which distinctly increases the extraction surface, and consequently the extraction efficiency. It should be noted that the dual-baffle device renders it possible to conceive easily a geometry having an extraction surface superior to the prior art extraction surface, that is to say at the surface of the extraction grid. On the other hand, the preservation of the plasma and materials in the baffles, and above all in the downstream baffle (20), is promoted by the presence of the folded edges 21 (and/or 11), downstream at a distance of $d_1$ (and/or $d_2$), respectively.

The parameters affecting the extraction are the potential h between the baffles 10 and 20, the width $l_1$ of the gaps between the apertures of the upstream baffle 10, the width $l_2$ of the apertures 16 of the upstream baffle 10, it being understood that the downstream baffle 20 is the "negative" of the upstream baffle 10.

The quantity of extracted electrons grows:

in the same sense as h inversely to the evolution of $l_2$ and $l_1$, i.e. versus the number of cells.

Moreover, the electric field applied determines the quantity of extracted electrons. Two extreme positions (30A: extraction electrodes not downstream of the aperture edges; 30B: extraction electrodes in the centre of the apertures and the gaps between them) for identical biases correspond to the extraction maximum (30A) and minimum (30B), knowing that the interception by the extracting electrode is at its maximum at (30A).

The maximum ideal efficiency corresponds to:

$$l_1 \leqq l_2 < h$$

and to the shape 14 of the plasma disc of FIG. 3*c*.

Figure 6:
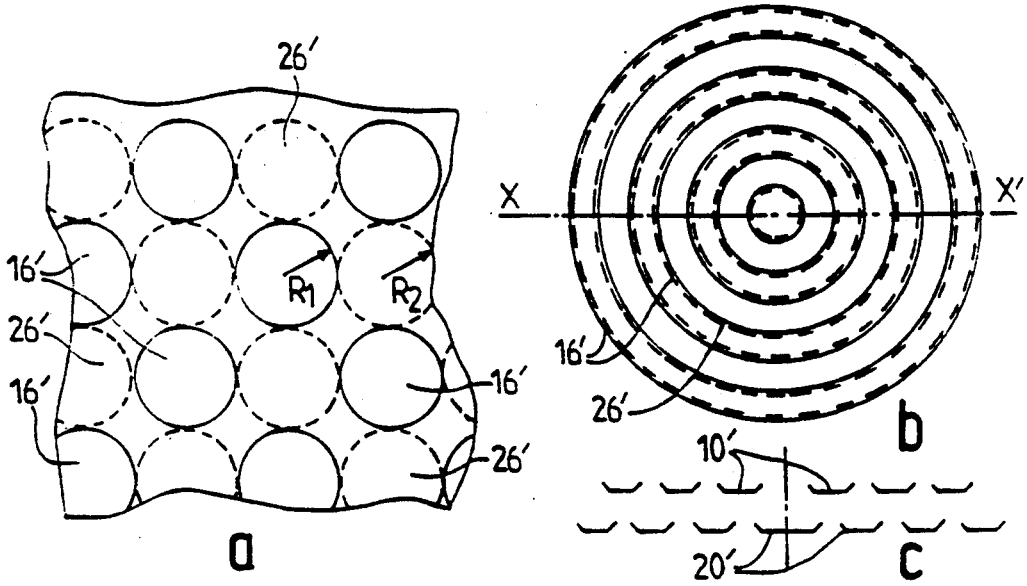

The structure of the preferred configuration of the baffles result from these considerations:

linear structures with $l_1 \leqq l_2$ and $h > l_2$ having extraction electrodes constituted by wires (or bars) near the aligned raised edges (11 and 21) of the baffles 10 and 20, and slightly masked by the baffle 20 (FIGS. 3*a* and 3*b*).

structures having round apertures (16', 26') (FIG. 6*a*) for the cylindrical (rotational or non-rotational) beams and more specifically when the homogeneity must have an axial symmetry (FIGS. 6*b* and 6*c*): in FIGS. 6*b* and 6*c*, the upstream 10 and downstream 20 baffles become raisededge rings 10' and 20', interconnected along the radii to ensure mechanical support (in FIG. 6*b*, the rings 16' are shown by means of broken lines).

For two rings (baffles 10' and 20') of the order i and i−1, it holds that:

$$R_{10',i}-R_{10',(i-1)} \leqq R_{20'i}-R_{20',i-1}$$

$$h > R_{20',i}-R_{20',i-1}.$$

Figure 7:
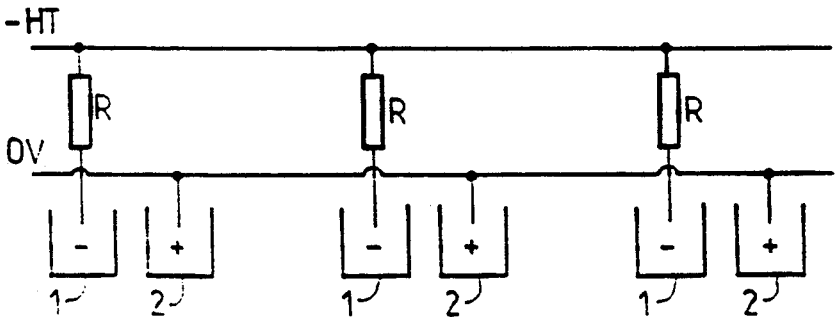
FIGS. 7 and 8 show parallel plasma source connection modes with a view to obtaining a large-section electron emission and FIGS. 9, 10, 11 and 12 are four variations of the invention having an improved extraction, FIG. 12 corresponding to a preferred embodiment.
Figure 8:
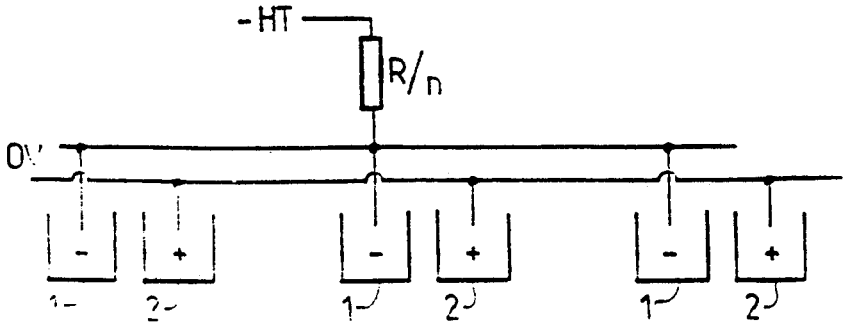

As is shown in FIGS. 7 and 8, a large-sized source is obtained by arranging n plasma sources in parallel, distributed such as to ensure a uniform plasma densities across the baffles 10 and 20 (or 10' and 20'). These sources are either supplied individually from a source (−HT) via a resistor R for each source (FIG. 7) or collectively via a single resistor R/n (FIG. 8).

Figure 9:
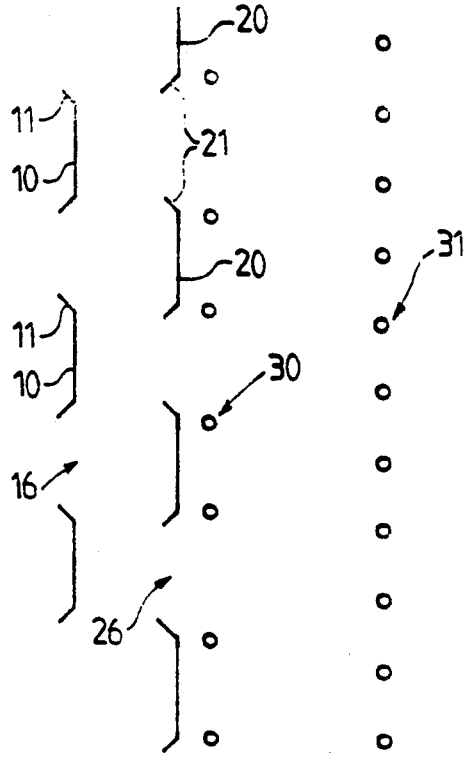
Figure 10:
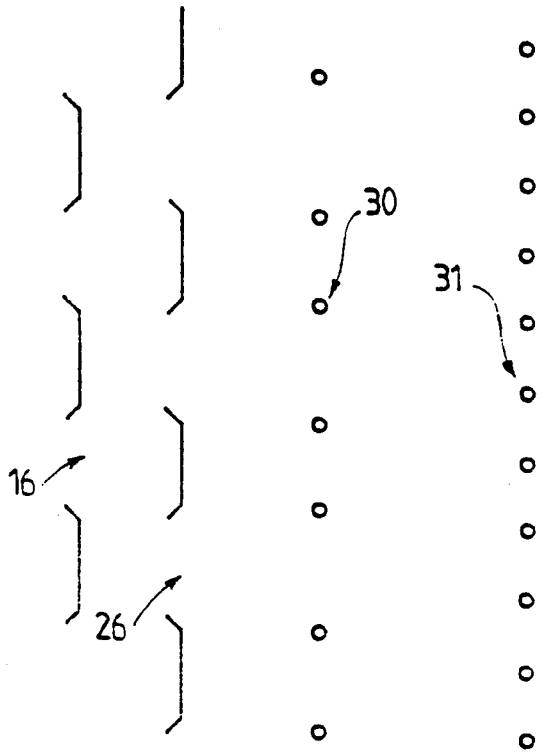

As is shown in FIGS. 9 and 10, two extraction grids, having reference numerals 30 and 31, arranged one behind the other, are made operative. The second extraction grid 31, at the same potential as the first, prevents electron accelerating electrons from entering and permits a free transfer thereof through a distance D exceeding the pitch $(l_1+l_2)$ of the extraction baffles. This enables overlap of the beams extracted from the apertures 26 contiguous to the downstream baffle 20 and reduces the density distortions. As is shown in FIG. 9, the upstream extraction grid is located near the downstream baffle 20, whereas, as shown in FIG. 10, it is remote therefrom.

Figure 11:
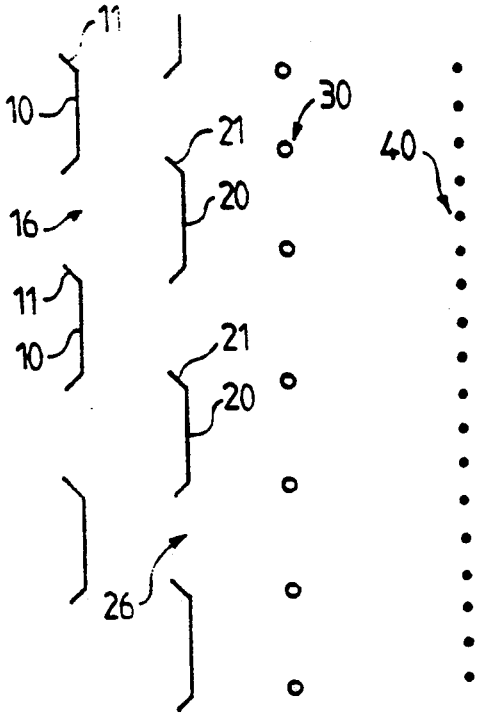
Figure 12:
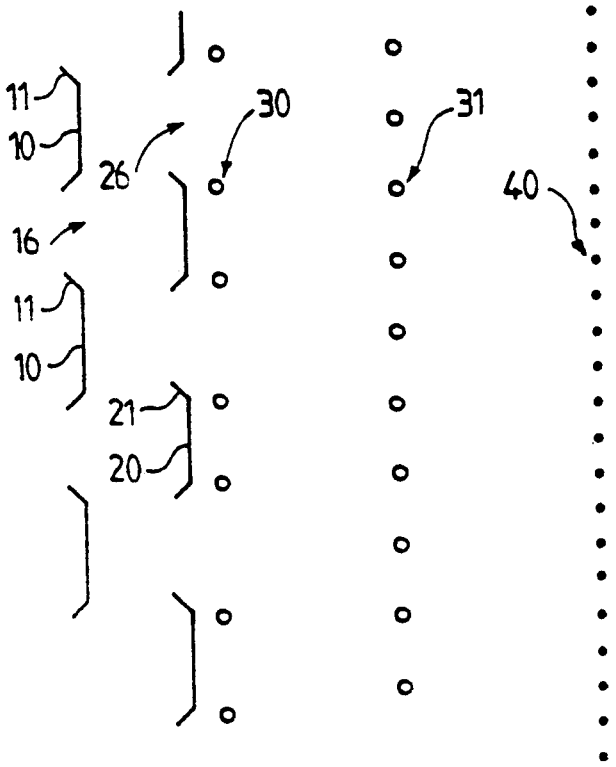

As is shown in FIGS. 11 and 12, an electron energy reducing grid (40) is provided downstream of the extraction grid(s) (30,31). The grid 40 is adjusted to a potential less than that of the extraction grid(s) (30,31). FIG. 11 shows only the extraction grid 30. In FIG. 12, the grid 40 is associated with two extraction grids 30 and 31, hence the extraction and the energy of the electrons are optimized simultaneously. The potential of the grid 40 may be adjusted to between the voltage of the extractor device (30, 31) and the biasing voltage of the baffles (10, 20).

I claim:

1. A vacuum arc electron source comprising a plasma source having an anode and a cathode facing each other such that they produce a plasma after an appropriate voltage difference has been applied between the anode and the cathode, an electron extractor device and a material-retaining device arranged between the extractor device and the plasma source, characterized, in that, the material-retaining device includes, arranged in the electron extraction direction, at least an upstream baffle and a downstream baffle which are both electrically conducting and have apertures arranged, such that when the baffles and are brought to a given potential, the plasma does not extend to downstream of the downstream baffle.

2. An electron source as claimed in claim 1, characterized, in that at least one of said apertures is a slot extending transversely to the direction of extraction of the electrons.

3. An electron source as claimed in claims 1, characterized, in that, at least one baffle has around at least one aperture an edge which is folded at the side facing the plasma source.

4. An electron source as claimed in claim 1, characterized, in that, the width of the apertures of the downstream baffle exceeds or is equal to the gap between the apertures.

5. An electron source as claimed in claim 1, characterized, in that, the distance between the baffles is at least equal to the width of the apertures and the gap between the apertures.

6. An electron source as claimed in claim 1, characterized, in that, the extractor device includes at least one extraction electrode.

7. An electron source as claimed in claim 6, further including, arranged in the electron extraction direction, an upstream extraction electrode and a downstream extraction electrode, arranged substantially in parallel.

8. An electron source as claimed in claim 7, characterized, in that, at least one extraction electrode is provided in the path located downstream of the apertures of the downstream baffles in the extraction direction of the electrons.

* * * * *